US007886829B2

(12) United States Patent
Edwards

(10) Patent No.: US 7,886,829 B2
(45) Date of Patent: Feb. 15, 2011

(54) SUBSEA TANKER HYDROCARBON PRODUCTION SYSTEM

(76) Inventor: David Lindsay Edwards, 7 Windmill Close, Ely, Cambridgeshire (GB) CB6 3YH ( * ) Notice: Subject to any disclaimer, the term of this patent is extended or adjusted under 35 U.S.C. 154(b) by 719 days.

(21) Appl. No.: 11/794,840

(22) PCT Filed: Jan. 9, 2006

(86) PCT No.: PCT/GB2006/000066

§ 371 (c)(1),
(2), (4) Date: Jul. 6, 2007

(87) PCT Pub. No.: WO2006/090102

PCT Pub. Date: Aug. 31, 2006

(65) Prior Publication Data

US 2008/0210434 A1 Sep. 4, 2008

(30) Foreign Application Priority Data

Jan. 12, 2005 (GB) ..... 0500587.1

(51) Int. Cl.
*E21B 29/12* (2006.01)
*E02D 25/00* (2006.01)

(52) U.S. Cl. ..... 166/357; 166/344; 166/352; 405/210

(58) Field of Classification Search ..... 166/356, 166/344, 352, 357; 175/5, 66; 405/210, 405/128

See application file for complete search history.

(56) References Cited

U.S. PATENT DOCUMENTS 3,067,712 A * 12/1962 Doerpinghaus ..... 114/74 T
3,113,699 A * 12/1963 Crawford et al. ..... 222/23
3,261,398 A * 7/1966 Haeber ..... 166/352
3,503,443 A * 3/1970 Trageser et al. ..... 166/344
3,552,131 A * 1/1971 Mott et al. ..... 405/210
3,643,447 A * 2/1972 Pogonowski ..... 405/210
3,754,380 A * 8/1973 McMinn et al. ..... 96/113
3,837,310 A * 9/1974 Toyama ..... 114/257
3,982,401 A * 9/1976 Loggins ..... 405/200
4,095,421 A * 6/1978 Silcox ..... 60/398
4,232,983 A * 11/1980 Cook et al. ..... 405/210
4,365,576 A * 12/1982 Cook ..... 405/200
4,669,916 A * 6/1987 White et al. ..... 405/224
4,972,907 A * 11/1990 Sellars, Jr. ..... 166/353
5,050,680 A * 9/1991 Diehl et al. ..... 166/356
5,117,914 A * 6/1992 Blandford ..... 166/344
5,297,632 A * 3/1994 Blandford ..... 166/344
5,433,273 A * 7/1995 Blandford ..... 166/344

(Continued)

FOREIGN PATENT DOCUMENTS

GB 2005329 A * 4/1979

(Continued)

*Primary Examiner*—Thomas A Beach

(57) ABSTRACT

A subsea and modular tanker-based hydrocarbon production system comprising a plurality of interlinked individual tank units which is wholly submersible, is wholly detachable from, and wholly re-attachable to, its associated subsea well-head infrastructure. Modularity of the interlinked tank unit system allows for the processing, measurement, and storage of hydrocarbons from a wide variety of offshore hazard and water-depth related conditions and situations. In addition to being both detachable and re-attachable, the modularity of the system provides for a number of unit systems to be conjoined at surface and towed to market.

7 Claims, 3 Drawing Sheets

U.S. PATENT DOCUMENTS 5,549,164 A * 8/1996 Blandford ..... 166/344
5,899,637 A * 5/1999 Blanchard et al. ..... 405/210
6,062,313 A * 5/2000 Moore ..... 166/357
6,299,672 B1 * 10/2001 Rivas ..... 95/243
6,345,672 B1 * 2/2002 Dietzen ..... 175/66
6,640,901 B1 * 11/2003 Appleford et al. ..... 166/357
6,796,379 B1 * 9/2004 Martin ..... 166/356
6,863,474 B2 * 3/2005 Webster et al. ..... 405/210
7,086,472 B1 * 8/2006 Incoronato ..... 166/357
7,185,705 B2 * 3/2007 Fontana ..... 166/356
7,261,164 B2 * 8/2007 Hollier ..... 166/356
7,287,935 B1 * 10/2007 Gehring ..... 405/223.1
7,520,989 B2 * 4/2009 Ostergaard ..... 210/512.1

FOREIGN PATENT DOCUMENTS

GB 2226963 A * 7/1990
GB 2284629 A * 6/1995
GB 2325485 A * 11/1998
RU 2016169 * 7/1994

* cited by examiner

SUBSEA TANKER HYDROCARBON PRODUCTION SYSTEM

BACKGROUND OF THE INVENTION

This invention relates to a subsea tanker hydrocarbon production system.

Much of the exploitation of hydrocarbon deposits is conducted in the realm of deep offshore waters. In fact some of the largest and most prolific such deposits are to be had in deep waters. So deep are these waters that existing subsea hydrocarbon extraction technology is utilised at its very operational limits.

Hitherto there have been two methods of hydrocarbon production offshore. The first utilises platforms raised above wave-height sitting upon concrete and/or steel towers which are themselves fixed to the seabed. Such towers are extraordinarily expensive. The second utilises subsea wellheads and clusters of tied-back subsea wellheads, production from which is conducted via a flexible riser pipe to a floating production station. Although less expensive than a fixed platform, a considerable amount of costly marine infrastructure is required for such an operation. What both of these methods have in common is their production facility, i.e. that which is placed upon the platforms, whether they be fixed or floating. Such a production facility concerns itself with a separation of the produced fluids (the various gas and oil phases, together with any produced associated water) and their subsequent measurement. It is usually the oil (and gas condensate) phases which are most prized, and are despatched to market. In the case of the fixed platforms this despatch is by seabed pipeline, and in case of the floating stations, by ship. The gas phases are often considered as less valuable, and depending on the economics of any particular project and its location, are variously disposed of, via alternative pipelines, re-injected back into the hydrocarbon reservoir rock elsewhere, or simply flared, i.e. burnt. Many authorities consider the flaring of gas phases, a common feature, as unnecessarily wasteful. Whilst such separation is a continuous process, the requirement for measurement is met by the intermittent diversion of production flows from individual wells. This is performed via a smaller and dedicated measuring separation train, and flows so measured are then rerouted back into the continuous process. Whilst the measurement of the productivity of individual wells contributes nothing to immediate economics, such measured data is essential for the extractive management of the hydrocarbon deposit (i.e. the reservoir) as a whole. Further, notwithstanding any financial or technical considerations, such processing operations are notoriously hazardous to personnel.

BRIEF SUMMARY OF THE INVENTION

According to the present invention there is provided a subsea and modular tanker-based hydrocarbon production system comprising a plurality of interlinked individual tank units which is wholly submersible, is wholly detachable from, and wholly re-attachable to, its associated subsea wellhead infrastructure. Modularity of the interlinked tank units allows for the processing, measurement, and storage of hydrocarbons from a wide variety of both offshore (i.e. hazard and water-depth related) and hydrocarbon reservoir conditions. Further, in addition to being both detachable and re-attachable, the modularity of the system provides for a number of unit systems to be conjoined at surface and towed to market.

BRIEF DESCRIPTION OF THE SEVERAL VIEWS OF THE DRAWING(S)

A specific embodiment of the invention will now be described by way of example with reference to the accompanying drawings in which:—

DETAILED DESCRIPTION OF THE INVENTION

Figure 1:
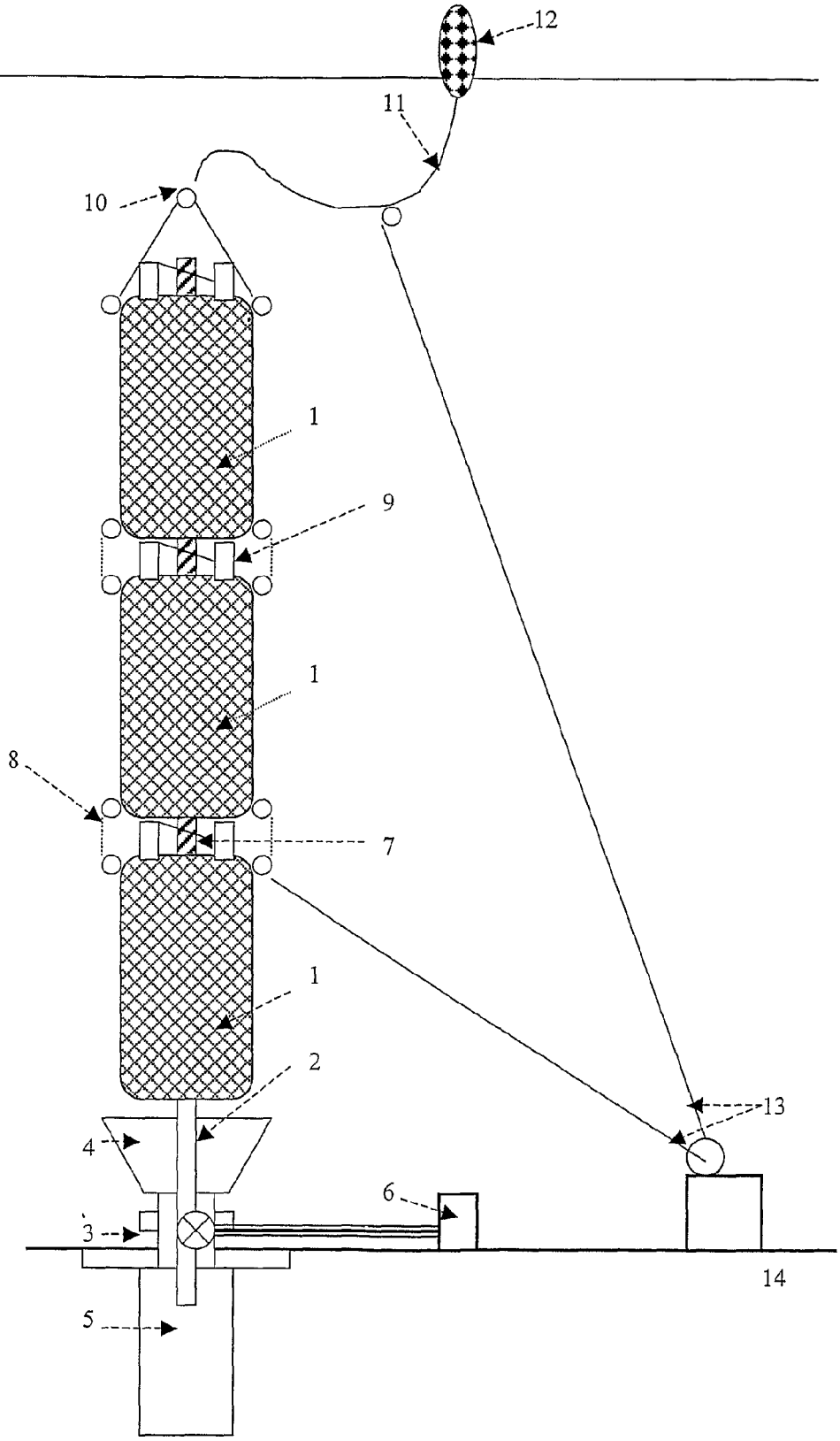
FIG. 1 illustrates a modular series of interlinked individual submersible tanks connected to its associated subsea wellhead infrastructure.

Referring to FIG. 1, a series of submerged and interlinked tanks 1 are connected by a stinger unit 2 stabbed, via a guide funnel 4, into a dedicated anchor station 3 which is permanently grouted 5 to the seabed. Hydrocarbons are produced from one or more adjacent subsea wells tied-back to the anchor station from a subsea manifold 6. The hydrocarbons migrate upwards from the anchor station into the series of interlinked tanks which are allowed to float vertically. Intervals of flexible high-pressure hose 7 provide the conduit for hydrocarbons between the respective interlinked tanks. Such intervals of connective high-pressure hose neither experience tension nor compression since longitudinal tension is constrained by two or more high-tensile steel chains shackled to pad-eyes 8, and longitudinal compression similarly constrained by steel cages 9. The uppermost of the series of interlinked tanks is connected to a crown shackle 10 and subsequently tethered by cable 11 to a marker buoy 12 which may or may not be permitted to break the surface. Gross lateral motion of the series of interlinked tanks may be restricted by additional tethering 13 anchored to one or more off-field concrete blocks 14.

Figure 2:
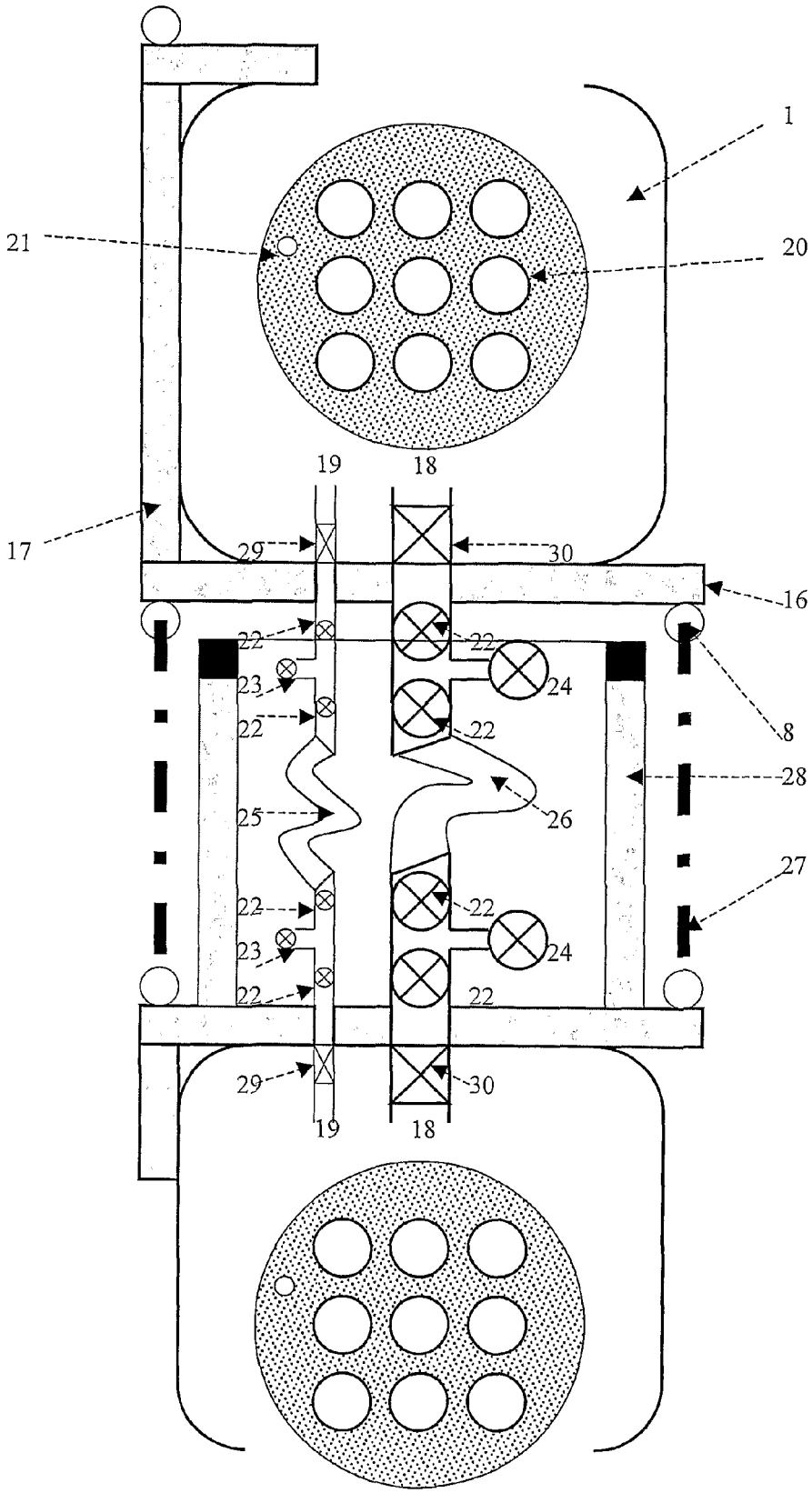
FIG. 2 illustrates schematically the means by which individual submersible tanks are linked and hydraulically-connected to each other, together with the internal components of such tanks in cross-section.

Referring to FIG. 2, the individual modular units of the series of interlinked production tanks are at their simplest vessels for the storage of produced hydrocarbons. Whilst they may be of a single flask structure, in this particular embodiment of the invention the individual production tanks comprise a number of parallel yet separate and individual charges, and illustrated in cross-section, 20. These charges may be constructed from standard high-pressure oil-field casing. The spacing between such charges and/or casings may be filled with protective materials such as fibres or polymers, or alternately, access may be allowed to seawater for coolant purposes. Such a multitude of storage charges are branched from the central production channel or conduit 18. They are similarly and consequently rebranched at the alternate end of each individual tank module again to a central production conduit (18). A gas conduit 19 is provided, in parallel with the central hydrocarbon conduit 18, although this does not serve any storage purposes. The central hydrocarbon production conduit 18 is equipped with hydraulically- and manually-activated master valves 22, together with similarly activated wing valves 24. Likewise, the gas conduit 19 is fitted with both master (22) and wing (23) valves. The hydrocarbon conduit 18 is connected to its corresponding feature on any adjacent interlinked tank module by an interval of flexible high-pressure hose 26. The gas conduit 19 is similarly connected to its corresponding feature on any adjacent interlinked tank module by an interval of flexible high-pressure hose 25. As stated above, such intervals of connective high-pressure hose neither experience tension or compression since longitudinal tension is constrained by two or more high-tensile steel chains 27 shackled to pad-eyes 8, and longitudinal compression is constrained by steel cages 9. The latter may comprise a circular arrangement of four or more Samson posts 28 topped with rubber bumper elements. The individual modular storage tanks themselves are not primarily load-bearing structures. Structural continuity of the interlinked series of tanks is provided for each and every unit by steel base plates 16 connected to longitudinal struts 17, and in turn, the steel bumper cages (28) and corresponding pad-eyes for chainage. The tops and bottoms, or rather their ends, of each tank are similar. Both conduits 18 and 19, and any subsequent branch conduits, may be fitted with flapper-type safety valves, fluid densometers, thermometers, pressure sensors, and hydraulically-activated production chokes; 29 and 30 respectively. Additionally the storage charges (20) may be fitted with baffles to aid and/or facilitate separation of oil and gas and to collect any produced sand and minor debris.

Figure 3:
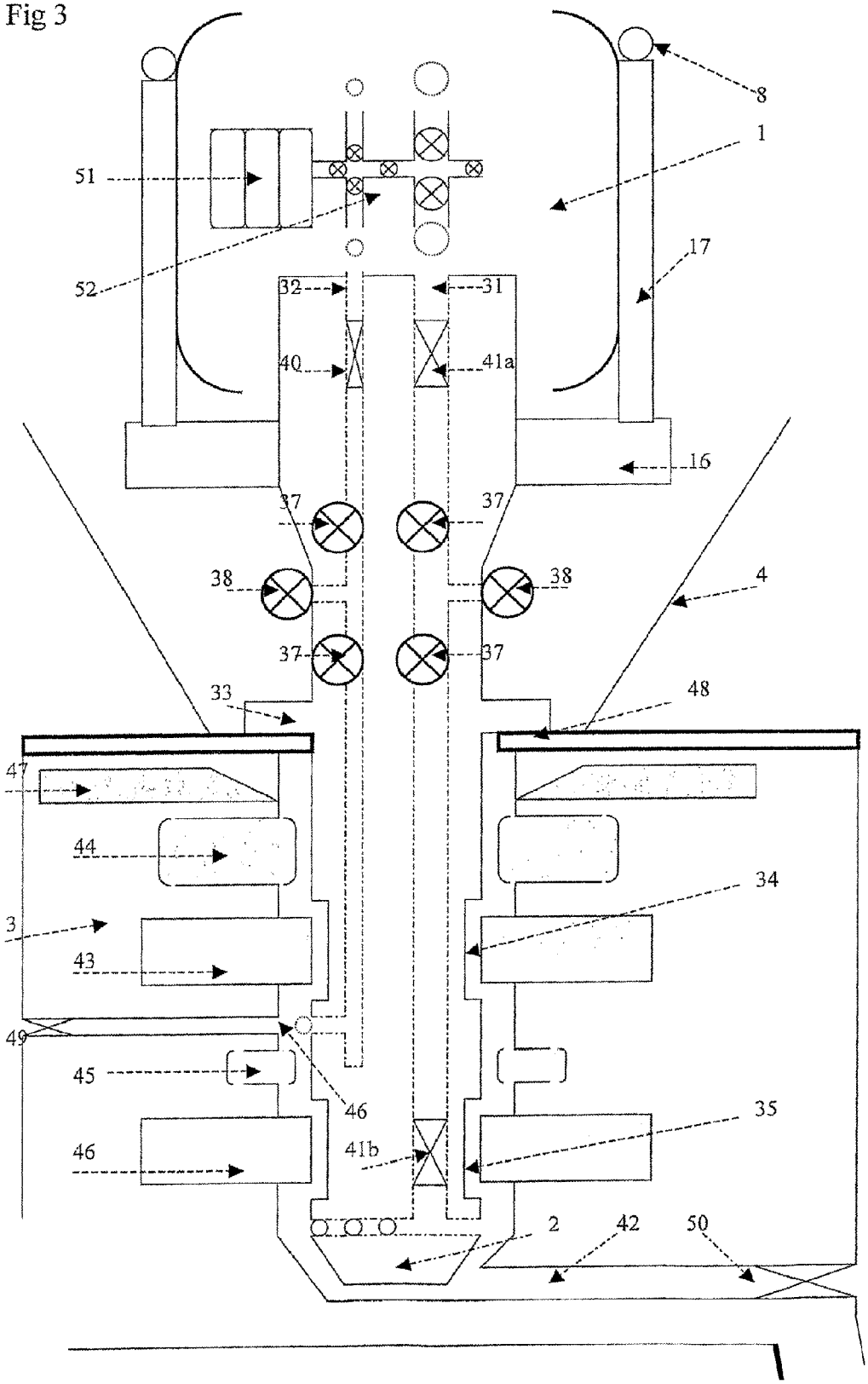
FIG. 3 illustrates in detail the means by which the first, or lowermost, of such a series of interlinked submersible tanks is connected to its associated subsea wellhead infrastructure, details of which are similarly provided.

Referring to FIG. 3, the first, or lowermost, of the series of interlinked submersible tanks is equipped with a stab-in and tensile load-bearing element 2 in structural continuity with a circular plate at the base of the tank 16 which in turn is in structural continuity with two or more load-bearing elements 17 which traverse longitudinally each and every one of the interlinking tanks terminating at the shackle pad-eyes 8. Through stab-in element 2 are bored the primary hydrocarbon conduits; a larger 31, and a smaller 32. The larger conduit corresponds to, and is contiguous with, the hydrocarbon conduit 18 (FIG. 2). The smaller conduit corresponds to, and is contiguous with, hydrocarbon conduit 19 (FIG. 2). These conduits are fitted with hydraulically- and manually-activated master valves 37, together with similarly activated wing valves 38. These valves may be utilised for pressure-testing purposes and to seal the tanks whilst in transit. Flapper-type fail-safe valves 40, 41*a* and 41*b* may also be integrated into the conduits together with hydraulically-activated chokes 41*a*. In this particular embodiment of the invention stab-in element 2 enters and accesses a chamber 42 in the anchor station. It is via such a chamber that the produced hydrocarbon stream (both oil and gas) enters the primary conduit (31) and subsequently into the series of interlinked tanks above (1). The primary bore, or conduit 32, accesses another chamber elsewhere in the anchor station 46. The primary purpose of conduit 32 is to provide for the subsequent disposal downwards of liberated gas, if necessary, after it having traversed all interlinked tanks. Structural and hydraulic integrity between the stab-in element 2 and the anchor station is provided for by a series of hydraulically-activated pipe-ram and annular-preventer bag element units. In this particular embodiment of the invention structural integrity is provided by two pipe-ram components 43 and 46. The rams are closed about recesses 34 and 35 in the stab-in element (2) after a no-go shoulder 33 lands out atop the anchor station 48. Hydraulic integrity is provided also by two annular-preventer bag components 44 and 45. Additionally these two annular-preventer bag components serve to divide the upcoming and down going hydrocarbon streams. Shear-ram elements 47 provide for the possibility to disconnect the series of interlinked tanks above it by severing the stab-in element (2) should either of the pipe-rams fail closed. Whilst the use of these elements here is not that for which they were originally intended, the function- and pressure-testing of such is well-known in the industry and need not be discussed here. Hydrocarbons are produced, via subsea manifold, from one or more adjacent and tied-back subsea wells enter the anchor station at 50. Similarly, gas may exit the anchor station 49 for subsequent distribution. In addition, within this the first of the series of interlinked production tank modules (1), a number of compressed-air cylinders 51 are provided to allow for recharge of the corresponding compressed-air cylinders used to function all ram- and annular-preventer elements, which may be performed via the conduits 32 prior to the commencement of any hydrocarbon production operations. Similarly, such tanks (51) may also serve, via a cross-over tee 52, to flush the hydrocarbon production chamber (42) of the anchor station of any residual hydrocarbons prior to disconnection of the stab-in element. Item 48, the top of the anchor station (3) may, optimally, be fitted with a hydraulically activated 'trash' cover. Inductive coupling may also be provided between items 33 and 43 to recharge any batteries associated with any electrically-controlled functions and monitoring functions of the anchor station. It should be noted that conduits 18 and 19 on the ultimate (uppermost) of the interlinked series of tanks need be mated, or otherwise closed.

Prior to any production operations the anchor station is positioned and grouted to the sea-bed at or about the time any operations are conducted to tie-back any subsea wellheads and subsea wellhead hubs. The modular series of interlinked subsea tanks is towed into approximate position on the surface by a suitable tendering vessel. Such a vessel need be equipped with a remote vehicle (ROV) facility to monitor operations subsea, a winch unit, and a pump unit. All mechanical and hydraulic connections between the individual interlinked storage tank modules should be established and pressure-tested. Hydraulically-operated recharge tanks (51/FIG. 3) should be charged. The entire series of interlinked tanks may be placed on vacuum (i.e. eliminated of air). Although not strictly essential, vacuum here serves two purposes; i) the tanks become more negatively buoyant and become thus freer to sink, and ii) the tanks may be filled with hydrocarbons without any subsequent requirement to vent. Under guidance from tether lines the interlinked tanks are then allowed to sink toward the anchor station. As the station is approached by the tanks, fine positioning may be facilitated by making adjustments to the winch and the position of the tendering vessel. The stab-in element is allowed to enter the anchor station until it lands out, as described above. Concerning specifically the anchor station; the lower set of pipe rams is then closed and the chamber below it pressure-tested and the entire system subsequently load (tensile) tested. Likewise, the remaining pipe rams and annular-preventer bag elements are individually functioned and pressure-tested. Finally, and returning again specifically to the stab-in production unit and its modular series of interlinked tanks, all master valves are ascertained as open, and the many individual production chokes set as appropriate (i.e. as defined by the reservoir operations management team) which of course may be varied throughout the course of production. Once filled, the reverse of the above described sequence may be initiated. Production should cease from the subsea hubs feeding the anchor station, and the small chamber within the chamber through which production is facilitated should be flushed of hydrocarbons; by air and/or seawater. The gas conduit may be utilised to recharge the hydraulic units of the anchor station associated with pipe-ram and annular-preventer elements. All valves on the individual interlinked tank units should be activated to the closed position, and the pipe-ram and annular-preventer elements of the anchor station subsequently opened. By virtue of its hydrocarbon charge, the series of tanks should be positively buoyant. Movement may (again) be controlled by the winch on the surface tendering vessel. At surface, a replacement series of interlinked tanks may be connected to the (primary) stab-in element and subsequently re-positioned. The remainder may be conjoined and towed to market. By such a system, field development may be considered as wholly contingent on what each and every well alone may produce without reference to complex and costly surface infrastructure. There need be no limit to the size or number of said units interlinked save the strength of the materials used in their manufacture.

The invention claimed is:

1. A hydrocarbon collection system comprising: an anchor station positioned on a sea bed to receive hydrocarbons from a sub-sea well; and a submersible modular collection unit comprising interlinked tank units, means for docking to the anchor station to collect liquid and gaseous hydrocarbons from the sub- sea well, means for removing the collection unit, and submersible separating means for separating gases that have separated from liquids; the collection unit including a stab-in means for conducting the hydrocarbons therethrough, the collection unit when filled with hydrocarbons is detachable from the anchor station using the stab means, allowed to rise towards the sea surface and towed away.

2. A hydrocarbon collection system according to claim 1, wherein the anchor station is locatable at a different position on the sea bed to the sub-sea well, said system further comprising a conduit for conducting hydrocarbons from the sub-sea well to the anchor station.

3. A hydrocarbon collection system according to claim 1, wherein the stab means comprises a stab-in element adapted to be docked with the anchor station, the stab-in element comprising a conduit for conducting hydrocarbons from the anchor station to the collection unit.

4. A hydrocarbon collection system according to claim 1, wherein said stab means comprises a second conduit for conducting gases that have separated from hydrocarbon fluids within the collection unit, away from the collection unit.

5. A hydrocarbon collection system according to claim 1, wherein the anchor station comprises clamping means to secure the hydrocarbon conducting stab means to the anchor station when docked thereto.

6. A hydrocarbon collection system according to claim 4, wherein the tank units are interlinked to allow passage of hydrocarbons between tank units and arranged so that when the collection unit is docked to the anchor station the tank units form a chain extending upwards from the anchor station; with the tank unit occupying the position closest to the sea surface comprising connective means for gases, separated from hydrocarbon liquids, having traversed any tanks upwards within the chain of tank units, to enter into the second gas-conducting conduit for subsequent disposal downwards within the chain of tank units.

7. A hydrocarbon collection system according to claim 2, said system comprising a plurality of sub-sea wells each connected to the anchor station by a conduit for conducting hydrocarbons from each sub-sea well to the anchor station.

* * * * *